US008167733B2

(12) United States Patent
Pelz

(10) Patent No.: US 8,167,733 B2
(45) Date of Patent: May 1, 2012

(54) TRAINING DEVICE FOR READING A PUTTING GREEN

(76) Inventor: David T. Pelz, Austin, TX (US)

( * ) Notice: Subject to any disclaimer, the term of this patent is extended or adjusted under 35 U.S.C. 154(b) by 0 days.

(21) Appl. No.: 12/981,663

(22) Filed: Dec. 30, 2010

(65) Prior Publication Data

US 2011/0160003 A1 Jun. 30, 2011

Related U.S. Application Data

(60) Provisional application No. 61/291,696, filed on Dec. 31, 2009.

(51) Int. Cl.
*A63B 69/36* (2006.01)
*A63B 57/00* (2006.01)

(52) U.S. Cl. ..... 473/198; 473/404

(58) Field of Classification Search ..... 473/177, 473/178, 180–184, 186, 190–192, 194, 198, 473/404; 73/9
See application file for complete search history.

(56) References Cited

U.S. PATENT DOCUMENTS

| | | | | |
|---|---|---|---|---|
| 5,018,730 | A * | 5/1991 | Iliuta | 473/175 |
| 5,890,967 | A * | 4/1999 | Allen | 473/178 |
| 6,167,878 | B1 * | 1/2001 | Nickerson et al. | 124/64 |
| 6,749,526 | B2 * | 6/2004 | Hughes | 473/404 |
| 2004/0266562 | A1 * | 12/2004 | Gowan et al. | 473/416 |

* cited by examiner

*Primary Examiner* — Nini Legesse
(74) *Attorney, Agent, or Firm* — Welsh Flaxman & Gitler LLC

(57) ABSTRACT

A training device assisting golfers in reading putting greens includes a housing having a central cavity shaped and dimensioned for receiving the golf ball therein. The housing includes a closed first end and an open second end. A force producing mechanism is positioned at the closed first end of the housing and extends toward the open second end within the housing. The force producing mechanism is positioned within the housing for selective actuation thereof so as to contact and push forward a golf ball positioned within the housing. Upon actuation, the force producing mechanism launches the golf ball smoothly onto the golf putting green surface at a pre-determined speed.

23 Claims, 1 Drawing Sheet

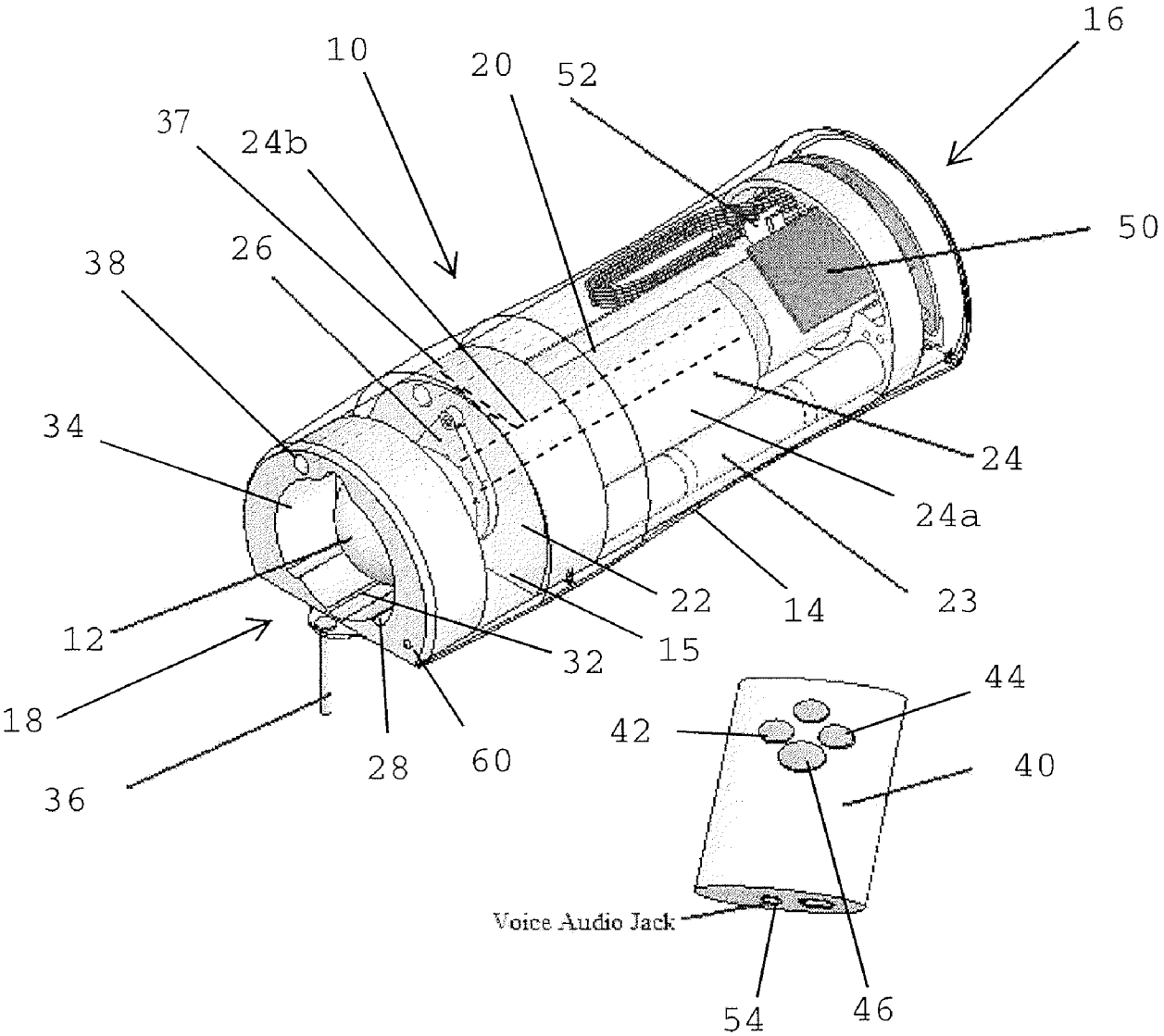
16
50
24
24a
23
44
40
46
14
54
22
15
42
Voice Audio Jack
52
32
20
60
10
28
24b
26
37
38
34
12
18
36

TRAINING DEVICE FOR READING A PUTTING GREEN

CROSS REFERENCE TO RELATED APPLICATION

This application claims the benefit of U.S. Provisional Patent Application Ser. No. 61/291,696, entitled "TRAINING DEVICE FOR READING A PUTTING GREEN", filed Dec. 31, 2009.

BACKGROUND OF THE INVENTION

1. Field of the Invention

The invention relates to a training device assisting golfers in developing the art of reading a putting green.

2. Description of the Related Art

One of the more difficult aspects of golf for those just learning the game, as well as for those with substantial experience, is "reading" a putting green. It is difficult for golfers to consistently combine all the factors involved with the movement of a golf ball upon a putting green in a repeating manner. The present invention assists golfers in reading putting greens by providing a training device allowing golfers to consistently and systematically roll a golf ball along a desired path with a desired acceleration in a highly controlled manner.

SUMMARY OF THE INVENTION

It is, therefore, an object of the present invention to provide a training device assisting golfers in reading putting greens. The training device includes a housing having a central cavity shaped and dimensioned for receiving the golf ball therein. The housing includes a closed first end and an open second end. A force producing mechanism is positioned at the closed first end of the housing and extends toward the open second end within the housing. The force producing mechanism is positioned within the housing for selective actuation thereof so as to contact and push forward a golf ball positioned within the housing. Upon actuation, the force producing mechanism launches the golf ball smoothly onto the golf putting green surface at a pre-determined speed.

It is also an object of the present invention to provide a training device wherein the housing is cylindrical.

It is another object of the present invention to provide a training device wherein the force producing mechanism includes a mechanical cup facing the open second end of the housing with an unobstructed path out the second end of the housing.

It is a further object of the present invention to provide a training device wherein the mechanical cup is shaped to cradle a 1.68-inch diameter golf ball.

It is also an object of the present invention to provide a training device wherein the force producing mechanism includes a linear voice coil motor with a mechanical cup attached thereto.

It is another object of the present invention to provide a training device wherein the linear voice coil motor includes a coil housing and a magnetic driving rod to which the mechanical cup is attached.

It is a further object of the present invention to provide a training device wherein the force producing mechanism includes an accelerometer based feedback loop.

It is also an object of the present invention to provide a training device wherein the housing includes a flat base for positioning upon the surface of the putting green.

It is another object of the present invention to provide a training device wherein the housing also includes a removable spike extending downwardly from the flat base.

It is a further object of the present invention to provide a training device wherein the spike is positioned in front of the second end of the housing to duplicate the position of the front of a golfer's putter face relative to the ball position selected for the putt to be studied.

It is also an object of the present invention to provide a training device wherein the housing includes a hole for storage of the spike when it is not in use.

It is another object of the present invention to provide a training device including an alignment mechanism.

It is a further object of the present invention to provide a training device wherein the alignment mechanism is a built-in laser pointing in a direction in alignment with the longitudinal axis of the housing and, therefore, in alignment with the initial direction of travel for the golf ball as it leaves the second end of the housing.

It is also an object of the present invention to provide a training device including a remote control adjustment device which communicates with the training device via a receiver for actuation and control of the force producing mechanism.

It is another object of the present invention to provide a training device wherein the remote control adjustment device includes a fine setting and coarse setting.

It is a further object of the present invention to provide a training device wherein the remote control adjustment device is provided with a voice audio jack.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 1 is a perspective view of the present training device.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for teaching one skilled in the art how to make and/or use the invention.

In accordance with the present invention, and with reference to FIG. 1, the present invention provides a training device 10 which assists golfers in reading putting greens; that is, in understanding the speed and break of a golf putting green which affects (controls) the direction and distance of a golf ball 12 putted thereon. With this in mind, and as will be appreciated based upon the following disclosure, the present invention putts (pushes) a golf ball 12 at a known and controllable "putt power", as well as in a known and controllable aim direction, in order to better train golfers' green reading skills. The present training device 10 assists a golfer in understanding, and a teaching professional teaching, the finer points of putting within the game of golf. Knowing where to aim a golf putt and how hard to strike the putt are challenges that golfers face every day when putting on the contoured, sloped surface of a putting green.

Referring now to FIG. 1, the present training device 10 includes a cylindrical housing 14 having a central cavity 15 shaped and dimensioned for receiving the golf ball 12 therein, as well as the other functional components of the present training device 10. The housing 14 includes a closed first end 16 and an open second end 18. A force producing mechanism 20 is positioned at the closed first end 16 of the housing 14 and extends toward the open second end 18 within the housing 14. The force producing mechanism 20 is positioned within the housing 14 for selective actuation thereof so as to contact, and force (or push) forward and out the open second end of the housing 14, a golf ball 12 positioned within the housing 14.

Accordingly, the golf ball 12 is inserted into the open second end 18 and rolled rearwardly (that is, a short distance toward the closed first end 16 within the housing 14) to a position in contact with a mechanical cup 26 adjacent the first end 22 of the force producing mechanism 20 and facing the open second end 18 with an unobstructed path out the second end 18 of the housing 14. In accordance with a preferred embodiment, the distance from the first end 22 of the force producing mechanism 20 to the open second end 18 is approximately 2 inches. However, it is appreciated this distance is not critical to consistency. The consistency of the training device 10 comes from using the accelerometer to measure the actual acceleration that the ball experiences (the shuttle's acceleration of the driving rod 24*b* is measured by the accelerometer 52 and it is presumed the ball experiences the same acceleration). Because the actual acceleration is measured, variables like friction changes from temperature or dirt and coil voltage variations will have no effect. The distance from the first end 22 of the force producing mechanism 20 to the open second end 18 is short and the golf ball 12 is actually putted (pushed) out by the force producing mechanism and released at a point in front of the training device 10 (that is, beyond the open second end 18 thereof). As will be discussed below in greater detail, upon actuation of the force producing mechanism 20, the golf ball 12 is forced forward and out of the second end 18 of the housing 14 at a controlled speed.

In accordance with a preferred embodiment, the force producing mechanism 20 is a battery 23 powered linear voice coil motor 24 with a mechanical cup 26 attached thereto. Control of the putt speed or power of the linear voice coil motor 24 (referred to later as "putt power") is further enhanced by the addition of an accelerometer 52 based feedback loop wherein the putt speed is controlled by remote control adjustment device 40 operated by the golfer (the speed of the force producing mechanism 20 is detected and measured by the accelerometer 52 in a feedback loop). The cup 26 is shaped to exactly cradle the diameter of 1.68-inch diameter golf balls. In particular, the cup 26 is preferably semi-spherical and concave with an internal radius of curvature of 0.84 inch (conforming to the diameter of a standard 1.68 inch diameter golf ball) allowing the cup 26 to perfectly cradle the golf ball touching the whole back surface of the golf ball to achieve a perfect linear acceleration with no bouncing and lateral acceleration of velocity.

As will be appreciated, linear voice coil motors 24 are reliable electric motors composed of two separate parts in accordance with a preferred embodiment of the present invention, that is, the coil housing 24*a* and the magnetic driving rod 24*b*. By applying a voltage across the terminals of the coil housing 24*a* of the linear voice coil motor 24, the driving rod 24*b* is caused to move in one direction. Reversing the polarity of the applied voltage will move the driving rod 24*b* in the opposite direction. The generated force is proportional to the current that flows through the coil housing 24*a*. The cup 26 is secured to the free end of the driving rod 24*b* and is shaped and dimensioned for supporting lateral engagement with a golf ball 12 which, upon actuation of the linear voice coil motor 24, launches the golf ball 12 smoothly onto the golf putting green surface at a pre-determined "putt power."

As will be appreciated based upon the following disclosure, the cup 26 is oriented laterally to engage the side of a golf ball 12 sitting within the housing 14 so that upon actuation of the linear voice coil motor 24, force is applied in alignment with the longitudinal axis of the housing 14 so as to push the golf ball 12 from the first end 22 of the force producing mechanism 20 and out of the second end 18 of the housing 14 (to duplicate the launch of the ball as if struck by a golfer's putter). Controlled launch of the golf ball 12 from the first end 22 of the force producing mechanism 20 and out of the second end 18 of the housing 14 is achieved by the golf ball 12 being cradled in the cup 26 and carried/pushed forward at the speed set by the golfer (by remote control) and released at a height of approximately 1/16-inch above the green surface. The speed, launch direction and launch trajectory are created to simulate the conditions of a golf ball putted at that speed by a golfer's putter.

Although the housing 14 is cylindrical, it includes a flat base 30 for positioning upon the surface of the putting green. The housing 14 also include a removable spike 36 extending downwardly from the flat base 30 and in front of the second end 18 thereof (this position duplicates the position of the front of a golfer's putter face relative to the ball position selected for the putt to be studied). The spike 36 is frictionally fit within an aperture (not shown) formed in the flat base 30, allowing selective attachment and detachment of the spike as desired. The spike 36 is shaped and dimensioned (for example, a 1/8" diameter rod, 1 1/4" long, sharp on one end) to penetrate the putting green surface and fix the position of the training device 10 when used outdoors on a real putting green. It should be noted the spike 36 is removable and is not needed indoors when the training device 10 is used for putt-power training by a golfer. The housing 14 is, therefore, provided with a hole (or slot) 60 in which the spike 36 may be stored when not in use. When the spike 36 is inserted into the hole 60 a locking cam 37 is rotated to a position mechanically preventing the driving rod 24*b* from firing and holds the spike 36 within the hole 60 based upon a frictional interaction. With the spike 36 inserted into the putting green, the present training device 10 can be swiveled about an arc with the spike 36 functioning as the center thereof to adjust the aim direction (as a golfer would adjust the front face of his or her putter) of the present training device 10.

Controlled alignment of the training device 10 is further facilitated by the inclusion of a built-in laser 38 which is oriented to display laser light upon and/or just above the surface of the putting green adjacent the training device 10. The laser 38 is aligned to point in a direction in alignment with the longitudinal axis of the housing 14 and, therefore, in alignment with the initial direction of travel for the golf ball 12 as it leaves the second end 18 of the housing 14. The laser 38 is, therefore, used to verify the aim direction of the present training device 10 when it is positioned upon the putting surface and the laser 38 is activated by remote control by the golfer when setting-up or adjusting the alignment of the training device 10.

In accordance with a preferred embodiment, the training device 10 has an overall size with a length of 10 inches and a diameter of 4 inches. The track 32 discussed above further includes a golf ball holding spot in the form of a small recess (not shown) adjacent the first end 22 of the linear voice coil motor 24. This is where the user would load and position a golf ball for use.

In practice, the force applied by the force producing mechanism 20, that is, the "putt power", is set by using a remote control adjustment device 40 which communicates with the training device 10 via an RF receiver 50 incorporated into the training device 10 for actuation and control of the linear voice coil motor 24. The remote control adjustment device 40 includes a fine and coarse setting 42, 44. Actuation of the force producing mechanism for movement of the golf ball is also controlled remotely via an eject button 46 on the remote control adjustment device 40. Therefore, when each golf ball 12 is loaded into the present training device 10, the operator can adjust the putt power and then, based on trial and error, find the optimized putt power setting for any particular putt. The remote control adjustment device 40 is further provided with a voice audio jack 54. Once the golfer picks the spot on a green he or she wants to putt from, the trainer marks that spot with a sticker (similar to a standard Avery® dot sticker, except it sticks to grass) and then places the present training device 10 directly behind that spot. When the golf ball 12 is then putted (pushed) from the training device 10, it is released from the cup 26 (which is pushed by the driving rod 24*b* of the force producing mechanism 20) directly above the spot (as if struck from that spot by a golfer's putter).

The "putt power" is a unit of measure that will be used as a guide for future golfers. A putt power value indicates the number of feet the golf ball would roll on a flat putting green having a green-speed (as defined by the USGA) of 10.0. The putt power range for this version of the present device is 3.0 to 30.0. The coarse adjustment of putt power adjusts up or down by units of 1.0. The fine adjustment of putt power adjusts up or down by units of 0.1. However, it is certainly contemplated broader ranges of putt power may be implemented within the scope of the present invention.

This invention will enable the operator to instruct a golfer in all the variables involved with golf green reading when used outdoors on real putting greens, and to instruct a golfer on how to produce certain putt power putting strokes when used indoors for such practice. By not changing the aim of the unit, but changing only the putt power setting you can teach a golfer how putting speed affects the break of a putt. Conversely, by not changing the putt power setting and changing only the aim of the unit you can show how the slope of a green can affect the ball-roll distance. Then for any particular putt within the putt power range, the optimum putt power setting can be determined by rolling the ball so that if it just misses the hole, the ball will roll about 17" past the hole. This 17" past the hole guideline has been previously determined by the inventor to be the optimum ball speed to make the most putts. Using this guide, the present device can, through trial and error, find the optimum aim direction and putt power setting for any putt. This is very valuable information to the golfer. Then the golfer can be sure that his or her practice time is also optimized and train himself or herself to be better reader of putting greens. This invention contains replaceable batteries (not shown), a built in laser 38 for aim verification, and a custom computer board (not shown) which communicates with the user what the "putt power" setting is. In accordance with a preferred embodiment the housing is constructed with a stainless steel base with the remainder constructed from DELRIN (a polyoxymethylene engineering thermoplastic) and ABS (acrylonitrile butadiene styrene).

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A training device assisting golfers in reading putting greens, comprising:

a housing including a central cavity shaped and dimensioned for receiving a golf ball therein, the housing includes a closed first end and an open second end, a force producing mechanism is positioned at the closed first end of the housing and extends toward the open second end within the housing, the force producing mechanism is positioned within the housing for selective actuation thereof so as to contact and push forward the golf ball positioned within the housing;

the force producing mechanism includes a linear voice coil motor with a mechanical cup attached thereto; and wherein, upon actuation, the force producing mechanism launches the golf ball smoothly onto a golf putting green surface at a pre-determined speed.

2. The training device according to claim 1, wherein the force producing mechanism includes a mechanical cup facing the open second end of the housing with an unobstructed path out the second end of the housing.

3. The training device according to claim 2, wherein the mechanical cup is shaped to cradle a 1.68-inch diameter golf ball.

4. The training device according to claim 1, wherein the linear voice coil motor includes a coil housing and a magnetic driving rod to which the mechanical cup is attached.

5. The training device according to claim 1, wherein the housing includes a flat base for positioning upon the golf putting green surface.

6. The training device according to claim 1, further including an alignment mechanism including a built-in laser pointing in a direction in alignment with a longitudinal axis of the housing and, therefore, in alignment with the initial direction of travel for the golf ball as it leaves the second end of the housing.

7. The training device according to claim 1, further including a remote control adjustment device which communicates with the training device via a receiver for actuation and control of the force producing mechanism.

8. The training device according to claim 7, wherein the remote control adjustment device is provided with a voice audio jack.

9. A training device assisting golfers in reading putting greens, comprising:

a housing including a central cavity shaped and dimensioned for receiving a golf ball therein, the housing includes a closed first end and an open second end, a force producing mechanism is positioned at the closed first end of the housing and extends toward the open second end within the housing, the force producing mechanism is positioned within the housing for selective actuation thereof so as to contact and push forward the golf ball positioned within the housing;

wherein the force producing mechanism includes an accelerometer based feedback loop; and wherein, upon actuation, the force producing mechanism launches the golf ball smoothly onto a golf putting green surface at a pre-determined speed.

10. The training device according to claim 9, wherein the force producing mechanism includes a mechanical cup facing the open second end of the housing with an unobstructed path out the second end of the housing.

11. The training device according to claim 10, wherein the mechanical cup is shaped to cradle a 1.68-inch diameter golf ball.

12. The training device according to claim 9, wherein the housing includes a flat base for positioning upon the golf putting green surface and the housing also includes a removable spike extending downwardly from the flat base.

13. The training device according to claim 9, further including an alignment mechanism including a built-in laser pointing in a direction in alignment with a longitudinal axis of the housing and, therefore, in alignment with the initial direction of travel for the golf ball as it leaves the second end of the housing.

14. The training device according to claim 9, further including a remote control adjustment device which communicates with the training device via a receiver for actuation and control of the force producing mechanism.

15. The training device according to claim 14, wherein the remote control adjustment device is provided with a voice audio jack.

16. A training device assisting golfers in reading putting greens, comprising:

a housing including a central cavity shaped and dimensioned for receiving a golf ball therein, the housing includes a closed first end and an open second end, a force producing mechanism is positioned at the closed first end of the housing and extends toward the open second end within the housing, the force producing mechanism is positioned within the housing for selective actuation thereof so as to contact and push forward the golf ball positioned within the housing, the housing further includes a flat base for positioning upon the golf putting green surface and the housing also includes a removable spike extending downwardly from the flat base; and wherein, upon actuation, the force producing mechanism launches the golf ball smoothly onto a golf putting green surface at a pre-determined speed.

17. The training device according to claim 16, wherein the spike is positioned in front of the second end of the housing to duplicate a position of a front of a golfer's putter face relative to a golf ball position selected for a putt to be studied.

18. The training device according to claim 17, wherein the housing includes a hole for storage of the spike when it is not in use.

19. The training device according to claim 16, wherein the force producing mechanism includes a mechanical cup facing the open second end of the housing with an unobstructed path out the second end of the housing.

20. The training device according to claim 19, wherein the mechanical cup is shaped to cradle a 1.68-inch diameter golf ball.

21. The training device according to claim 16, further including an alignment mechanism including a built-in laser pointing in a direction in alignment with a longitudinal axis of the housing and, therefore, in alignment with the initial direction of travel for the golf ball as it leaves the second end of the housing.

22. The training device according to claim 16, further including a remote control adjustment device which communicates with the training device via a receiver for actuation and control of the force producing mechanism.

23. The training device according to claim 22, wherein the remote control adjustment device is provided with a voice audio jack.

* * * * *